US005145098A

United States Patent [19]

Tung

[11] Patent Number: 5,145,098

[45] Date of Patent: Sep. 8, 1992

[54] FOLDABLE AND TELESCOPIC GARMENT HANGER

[76] Inventor: Chen-Jen Tung, c/o Hung Hsing Patent Service Center P.O. Box 55-1670, Taipei, Taiwan

[21] Appl. No.: 723,895

[22] Filed: Jul. 1, 1991

[51] Int. Cl.[5] ..... A47G 25/40; A47G 25/14

[52] U.S. Cl. ..... 223/94; 223/89; 223/85

[58] Field of Search ..... 223/89, 94, 85, 88; 211/113; D6/315, 318

[56] References Cited

U.S. PATENT DOCUMENTS

| | | | |
|---|---|---|---|
| 1,344,665 | 6/1920 | Weber | 223/94 |
| 2,158,367 | 8/1950 | Penhallegon | 223/94 |
| 2,577,854 | 12/1951 | Marbit | 223/94 |
| 3,219,241 | 11/1965 | Newton | 223/94 |
| 3,531,028 | 9/1970 | Vazquez | 223/94 |
| 4,334,641 | 6/1982 | Marcum | 223/94 |
| 4,932,571 | 6/1990 | Blanchard | 223/94 |
| 5,044,534 | 9/1991 | Hwang | 223/94 |

FOREIGN PATENT DOCUMENTS

| | | | |
|---|---|---|---|
| 1328767 | 4/1963 | France | 223/94 |

OTHER PUBLICATIONS

Kodet, PCT/AU85/00103; Extendible Garment Hanger, Oct. 1985, pp. 1-7.

*Primary Examiner*—Werner H. Schroeder
*Assistant Examiner*—Bibhu Mohauty

[57] ABSTRACT

A hanger for hanging jacket, suit or dress includes a central hook holder having a hook pivotally secured in the holder, a pair of upper holding members pivotally secured to the central hook holder by a pair of first vertical-axis hinges, a pair of shoulder members respectively pivotally secured to the two upper holding members by a pair of horizontal-axis hinges each. The shoulder member is telescopically mounted with a slide member slidably held on each shoulder member for adjustably hanging dress or the like, and a second vertical-axis hinge pivotally connecting the two shoulder members. The two upper holding members can be first folded downwardly about the horizontal-axis hinges to be superimposed on the shoulder members which are then folded rearwardly about the two vertical-axis hinges to greatly minimize a total volume of the folded hanger for a convenient handling and portable use.

11 Claims, 4 Drawing Sheets

FOLDABLE AND TELESCOPIC GARMENT HANGER

BACKGROUND OF THE INVENTION

A conventional hanger includes two fixed shoulder bars protruding rightwardly and leftwardly from a central hanging hook for hanging a jacket, suit or dress thereon and a cross bar horizontally secured between the two shoulder bars for hanging a pair of trousers or the like. However, since the two shoulder bars of the conventional hanger are made as a fixed type, it can not be folded to minimize its volume, thereby being inconvenient for portable uses, especially unsuitable for travel purposes. Meanwhile the fixed shoulders of the hanger have a fixed length for each bar so that a jacket or a sweater of a big size, when hung on a small hanger having shorter length of the two shoulder bars than a width of two opposite shoulder portions of the jacket or sweater for a long time, will become crumpled, wrinkled or lumped.

The present inventor has found the drawbacks of a conventional hanger and invented the present foldable and telescopic hanger.

SUMMARY OF THE INVENTION

The object of the present invention is to provide a hanger for hanging jacket, suit or dress thereon including a central hook holder having a hook pivotally secured in the holder, a pair of upper holding members pivotally secured to the central hook holder by a pair of first vertical-axis hinges, a pair of shoulder members respectively pivotally secured to the two upper holding members by a pair of horizontal-axis hinges each the shoulder member telescopically mounted with a slide member slidably held on each shoulder member for adjustably hanging dress or the like, and a second vertical-axis hinge pivotally connecting the two shoulder members, so that the two upper holding members can be first folded downwardly about the horizontal-axis hinges to be superimposed on the shoulder members which are then folded rearwardly about the two vertical-axis hinges to greatly minimize a total volume of the folded hanger for a convenient handling and portable use.

DETAILED DESCRIPTION

Figure 1:
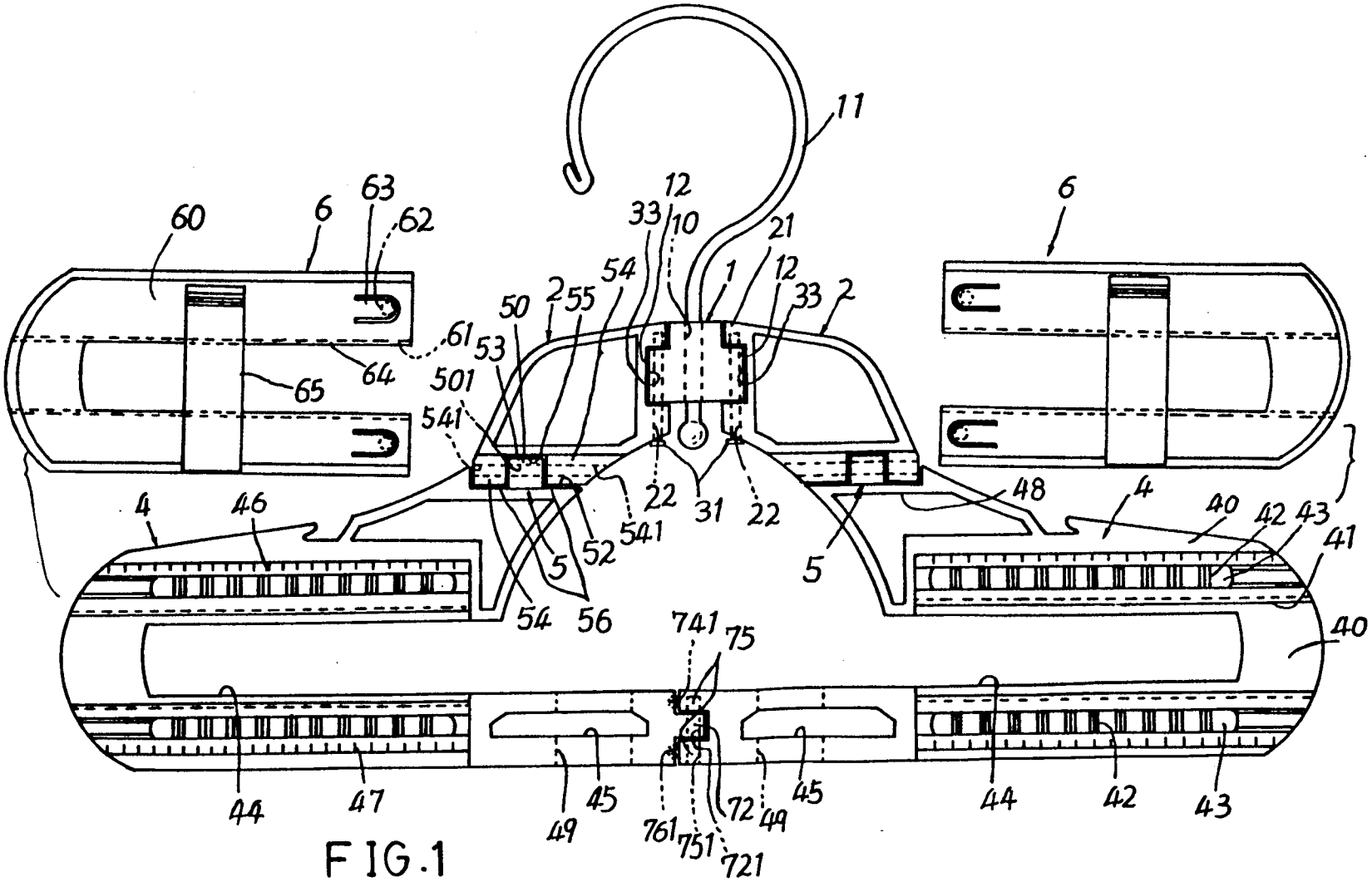
FIG. 1 is a front plan view of the present invention.

As shown in FIGS. 1–5, the present invention comprises: a central hook holder 1 having a hook member 11 pivotally secured therein, a pair of upper holding members 2 pivotally secured to the central hook holder 1 by a pair of first vertical-axis hinges 33, a pair of shoulder members 4 generally formed as an arcuate plate respectively pivotally secured to the two upper holding members 2 by a pair of horizontal-axis hinges 5, a pair of slide members 6 each slide member 6 slidably telescopically mounted on each shoulder member 4, and a second vertical-axis hinge 7 pivotally securing the two shoulder members 4.

The central hook holder 1 is formed with a central hole 10 for pivotally securing the hook member 11 in the hole 10, and formed with two pin holes 13 in two side cam portions 12 of the holder 1.

The first vertical-axis hinge 33 includes a first pin 31 inserted through a pin hole 22 formed in a first C-shaped bracket 21 formed in an upper inner side portion of one upper holding member 2 and inserted through the pin hole 13 formed in the side cam portion 12 of the holder 1 for pivotally connecting the side cam portion 12 with the first C-shaped bracket 21 of the upper holding member 4.

The side cam portion 12 is formed with a sloping surface 32 tapered frontwardly inwardly to be engageable with a corresponding sloping surface formed on a recess inner surface 33 of the C-shaped bracket 21 also tapered frontwardly inwardly.

Figure 2:
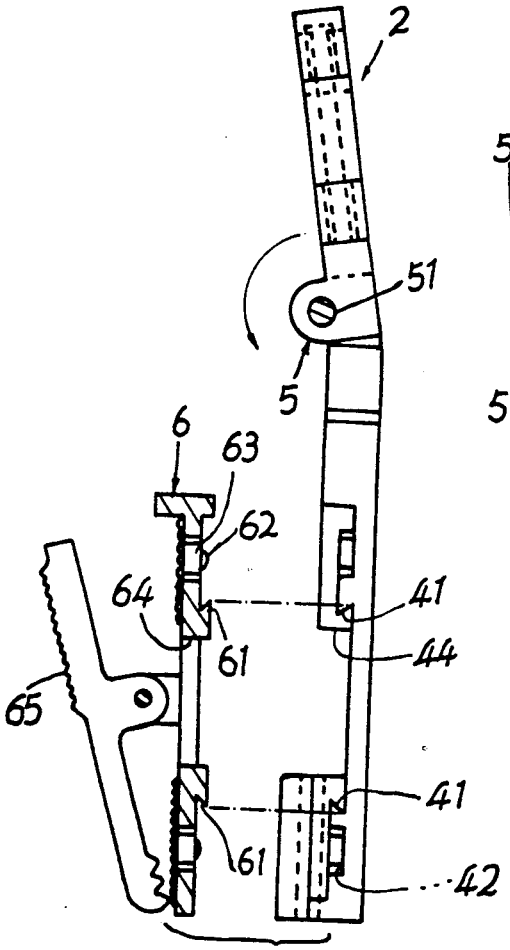
FIG. 2 is a side view of the present invention.
Figure 2A:
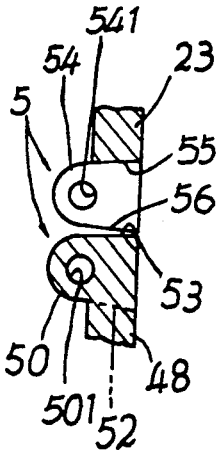
FIG. 2*a* shows a horizontal-axis hinge of the present invention.

The horizontal-axis hinge 5 as shown in FIGS. 2, 2*a* includes: a second pin 51 inserted through a pin hole 541 formed in a second C-shaped bracket 54 integrally formed on a lower portion 23 of the upper holding member 2, and through a pin hole 501 formed in a cam portion 50 integrally formed on a ridge portion 48 of the shoulder member 4 for pivotally connecting the cam portion 50 with the second C-shaped bracket 54.

The second C-shaped bracket 54 is formed with a recess upper surface 55 sloping frontwardly downwardly to be engageable with an upper cam surface 53 of the cam portion 50 sloping frontwardly downwardly, whereas a bottom surface 56 of the bracket 54 is inclined frontwardly upwardly to be engageable with a ridge surface 52 formed on the shoulder ridge portion 48 sloping frontwardly upwardly. Such sloping surfaces are provided to limit an angular (such as a straight angle) pivotal operation between the upper member 2 and the shoulder member 4.

Each shoulder member 4 includes: a substrate plate 40 generally rectangular shaped or U shaped having an arcuate end portion 40*a* having the ridge portion 48 pivotally secured to the holding member 2, a longitudinal groove 41 having a cross section of dovetail shape longitudinally formed through the plate 40, at least a rack 42 having corrugated teeth longitudinally formed on the plate 40 juxtapositonal to the groove 41 having a ratchet tooth 43 formed on an outer end portion of the rack 42, a longitudinal slot 44 formed in a central portion of the shoulder member 4, a bottom socket 45 formed in a bottom portion of the plate 40 for hanging belt or necktie thereon, an upper graduation scale 46 and a lower graduation scale 47 respectively formed on the upper edge portion or on a lower edge portion of the plate 40 for respectively measuring a shoulder width or a waist width of a user. The substrate plate 40 is generally U-shaped as shown in FIG. 1.

Each slide member 6 as shown in FIG. 1, 2 includes: a sliding plate 60 generally U-shaped, a longitudinal extension 61 having a cross section of dovetail shape slidably engageable with the longitudinal groove 41 of the shoulder member 4, at least a positioning protrusion 62 formed on a spring plate 63 which may be directly punched on the plate 60 to be adjustably engageable with the teeth of the rack 42 formed on the shoulder member 4, and a spring clip 65 secured on the plate 60 for hanging trousers or skirts thereon.

Figure 3:
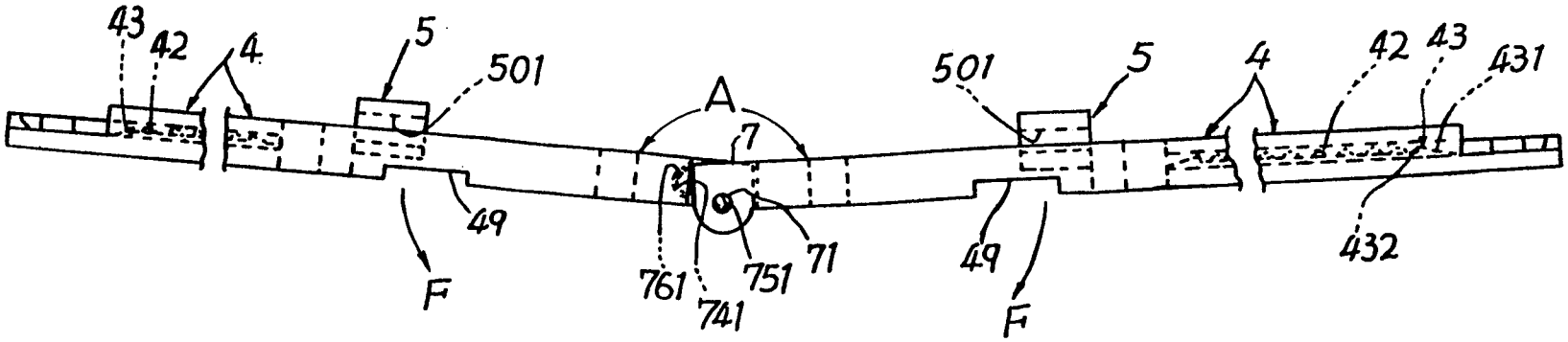
FIG. 3 is a bottom view of the present invention.

The ratchet tooth 43 formed on the shoulder member 4 as shown in FIG. 3 includes a sloping surface 431 tapered downwardly outwardly adapted for a sliding insertion of the protrusion 62 of the slide member 6 and an angled recess 432 recessed downwardly from an inner end portion of the sloping surface 431 for retaining the protrusion 62 to prevent a releasing of the slide member 6 from the shoulder member 4 once mounted with the slide member 6 thereon.

Figure 4:
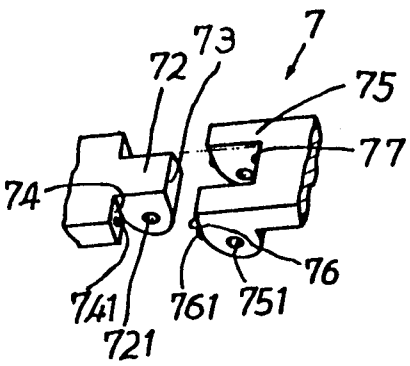
FIG. 4 is an illustration showing a vertical-axis hinge for coupling the two shoulder members of the present invention.
Figure 5:
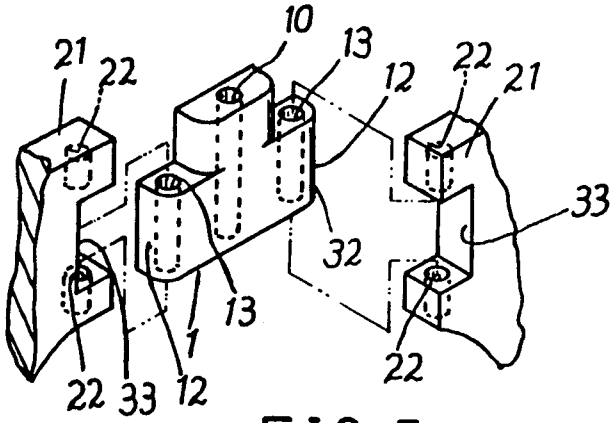
FIG. 5 is an illustration of the central hook holder of the present invention.

The second vertical-axis hinge 7 as shown in FIGS. 3, 4 includes: a bottom cam portion 72 secured with one shoulder member 4 pivotally connected with a third C-shaped bracket 75 secured with the other shoulder member 4 by a third pin 71 inserted through two pin holes 721, 751 respectively formed in the cam portion 72 and the bracket 75.

The bottom cam portion 72 is formed with a cam surface 73 tapered rearwardly to projectively define an acute angle with a base surface 74 adjacent to the cam portion 72 and sloping rearwardly. The cam surface 73 is engageable with a bottom recess inner surface 77 recessed in the C-shaped bracket 75 and sloping rearwardly to projectively define an acute angle with a side bracket surface 76 sloping rearwardly and engageable with the base surface 74. The side bracket surface 76 may be formed with a retaining protrusion 761 engageable with a retaining hole 741 formed in the base surface 74 so as to stably extend the two shoulder members 4 to have a general straight angle A defined between the two members 4 as shown in FIG. 3. The sloping surfaces of the cam portion 72 and bracket 75 will limit an angular pivotal rotation of the two members 4 such as for defining a limiting angle A. Other hinges 5, 3 may be formed with each retaining protrusion and hole on the cooperative engaging parts.

Figure 6:
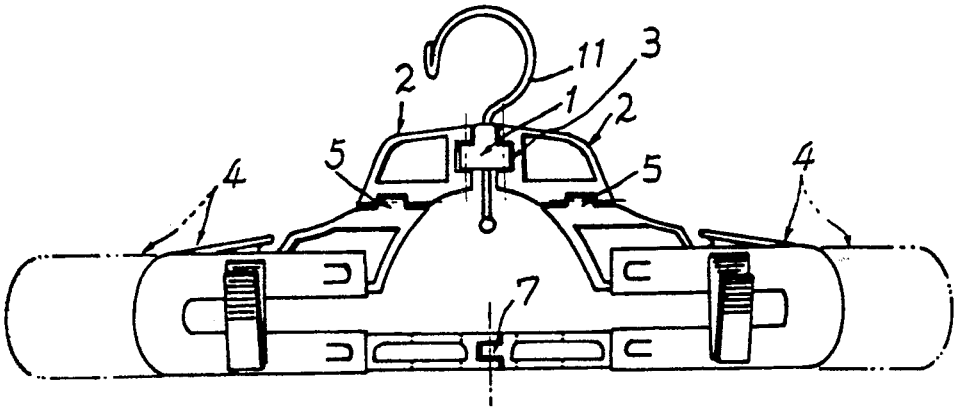
FIG. 6 shows a telescopic hanger in accordance with the present invention.

For hanging a user's clothings on the hanger of the present invention, the two slide members 6 can be optionally slid on the substrate plates 40 of the shoulder members 4 as shown in FIG. 6 until matching with a width of the dress, jacket, coat, or suit in order for keeping a suitable hanging of the clothings for preventing their crumpling or lumping.

Figure 7:
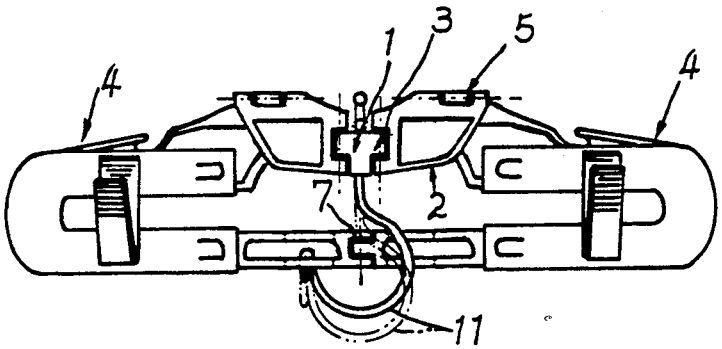
FIG. 7 shows a first folding step of the present invention being folded.
Figure 8:
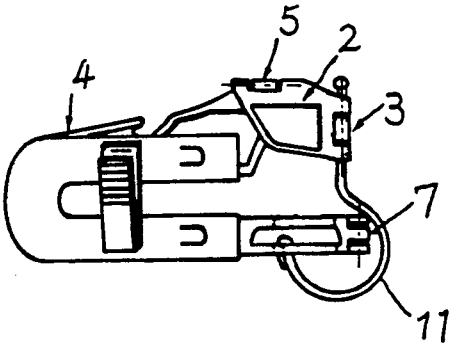
FIG. 8 shows a finally folded hanger in accordance with the present invention.

If for portable use such as being carried for a user's trip, the two upper holding members 2 can be folded downwardly to superimposed the shoulder members 4 as shown in FIG. 7 about the horizontal-axis hinge 5. Then, the hanger is folded by folding one half of the members 2, 4 rearwardly as shown in FIG. 8 about the two vertical-axis hinges 3, 7 to projectively superimpose one upper member 2 and one shoulder member 4 to the other upper member and shoulder member. The upper vertical-axis hinges 3 are formed as two hinges 3 in order for receiving a folded thickness occupied by the hinges 5, and holding members 2. The hinges 5, 7 are respectively formed with cam portions 50, 72 for receiving a folded thickness occupied by the folded members 2, 4.

The shapes and structures of hinges 3, 5, 7 of the present invention are not limited and can be modified to be other kinds of hinges. The two hinges 3 for pivotally securing the two holding members 2 to the hook holder 1 may be simplified to be a single hinge.

After folding the hanger of the present invention, the hook member 11 can be stored and inserted into the shoulder members 4 through the slots 49 formed in the shoulder members 4. The present invention may be suitably modified without departing from the spirit and claiming scope of this invention.

I claim:

1. A hanger comprising:

a central hook holder having a hook member pivotally held in the hook holder;

a pair of upper holding members each pivotally secured to side portions of said central hook holder by an upper hinge;

a pair of shoulder members each of said shoulder members pivotally secured to an upper holding member by a middle hinge;

a pair of slide members, of which one of said slide members is slidably telescopically mounted on one of said shoulder members, and the other said slide member slidably telescopically mounted on the other said shoulder member for adjustably hanging clothing thereon; and a lower hinge pivotally connecting two said shoulder members; said two upper holding members and said central hook holder being operatively foldable downwardly to superimpose said two shoulder members about said middle hinge, and all said members being further foldable rearwardly about said upper hinge and said lower hinge to projectively superimpose one of said upper holding members and one of said shoulder members on the other said other upper holding member and the other said shoulder member.

2. A hanger according to claim 1, wherein said upper hinge is a first vertical-axis hinge including: a first pin pivotally connecting a side cam portion formed on a side portion of said central hook holder and a first C-shaped bracket formed on an upper inner side portion of each one of said upper holding member.

3. A hanger according to claim 2, wherein said side cam portion is formed with a sloping surface tapered frontwardly inwardly to be engageable with a corresponding sloping surface formed on a recess inner surface of said first C-shaped bracket tapered frontwardly and inwardly for limiting a rotating angle between said hook holder and each said upper holding member.

4. A hanger according to claim 1, wherein each said shoulder member includes: a substrate plate having a upper ridge portion pivotally secured to said upper holding member, a longitudinal groove and at least a rack having corrugated teeth longitudinally formed thereon said rack being juxtapositional to said longitudinal groove.

5. A hanger according to claim 4, wherein said slide members include: a sliding plate having a longitudinal extension slidably engageable with said longitudinal groove in said substrate plate of said shoulder member, and at least a positioning protrusion resiliently formed on said sliding plate adjustably engageable with the corrugated teeth of said rack on said shoulder member for adjustably positioning said slide member on said shoulder member.

6. A hanger according to claim 5, wherein said positioning protrusion of said slide member engages a ratchet tooth formed on an outer end portion of said rack on said shoulder member.

7. A hanger according to claim 1, wherein said middle hinge is a horizontal-axis hinge including a second pin pivotally connecting a cam portion formed on said ridge portion of said shoulder member and a second C-shaped bracket formed on a lower portion of said upper holding member.

8. A hanger according to claim 7, wherein said second C-shaped bracket is formed with a recess upper surface sloping frontwardly downwardly to be engageable with an upper cam surface sloping frontwardly downwardly of said cam portion of said horizontal-axis hinge; said second C-shaped bracket having a bottom surface inclined frontwardly upwardly to be engageable with a ridge surface of said upper ridge portion of said shoulder member sloping frontwardly upwardly.

9. A hanger according to claim 1, wherein said lower hinge is a second vertical-axis hinge including: a bottom cam portion secured with one of said shoulder members, a third C-shaped bracket secured to the other said shoulder member and pivotally connected with said bottom cam portion with a third pin.

10. A hanger according to claim 9, wherein said bottom cam portion of said lower hinge is formed with a bottom cam surface tapered rearwardly to projectively define an acute angle with a base surface of the bottom cam portion sloping rearwardly, said bottom cam surface engageable with a bottom recess inner surface recessed in the third C-shaped bracket and sloping rearwardly to projectively define an acute angle with a side bracket surface of said third C-shaped bracket sloping rearwardly and engageable with said base surface of said bottom cam portion.

11. A hanger according to claim 10, wherein said side bracket surface of said third C-shaped bracket is formed with a retaining protrusion engageable with a retaining hole formed in said base surface of said bottom cam portion for stably extending said two shoulder members about said third hinge to define a generally straight angle therebetween.

* * * * *